US008505260B1

(12) United States Patent
Chang et al.

(10) Patent No.: US 8,505,260 B1
(45) Date of Patent: Aug. 13, 2013

(54) LATERALLY RESTRAINED JOINT STRUCTURE

(75) Inventors: Ching-Chang Chang, Taipei (TW); Sheng-Jin Chen, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 13/606,163

(22) Filed: Sep. 7, 2012

(30) Foreign Application Priority Data

May 15, 2012 (TW) ..... 101117237 A

(51) Int. Cl.
*E04B 1/38* (2006.01)
*E04B 1/98* (2006.01)
*E04C 5/00* (2006.01)

(52) U.S. Cl.
USPC ..... 52/704; 52/93.1; 52/167.3

(58) Field of Classification Search
USPC ..... 52/93.1, 167.3, 704, 393, 395, 656.9, 52/694, 646, 632, 645, 167.1, 655.1, 653.1
See application file for complete search history.

(56) References Cited

U.S. PATENT DOCUMENTS

| | | | | |
|---|---|---|---|---|
| 5,660,017 | A * | 8/1997 | Houghton | 52/655.1 |
| 6,634,153 | B1 * | 10/2003 | Peterson | 52/695 |
| 7,225,588 | B2 * | 6/2007 | Nakamura et al. | 52/167.3 |
| 7,703,244 | B2 * | 4/2010 | Suzuki et al. | 52/167.3 |
| 2003/0009977 | A1 * | 1/2003 | Houghton | 52/656.9 |
| 2006/0112652 | A1 * | 6/2006 | Ichikawa et al. | 52/167.1 |
| 2006/0243159 | A1 * | 11/2006 | Khattab et al. | 105/404 |
| 2010/0043316 | A1 * | 2/2010 | Karns | 52/167.1 |
| 2011/0030305 | A1 * | 2/2011 | Karns | 52/650.1 |

* cited by examiner

*Primary Examiner* — Mark Wendell

(57) ABSTRACT

A laterally restrained joint structure including a structural member, a gusset plate and at least one restraining member is disclosed. The gusset plate is connected to the structural member, and a two-force member is disposed opposite to the structural member and connected to the gusset plate. The restraining member is disposed over side or at edges of the gusset plate and connected to the structure member, so that the lateral deformation of the gusset plate can be controlled and the buckling strength of the gusset plate can be enhanced by the restraining member, and the laterally restrained joint structure is capable of reinforcing a building.

9 Claims, 18 Drawing Sheets

LATERALLY RESTRAINED JOINT STRUCTURE

BACKGROUND OF THE INVENTION

1. Field of the Invention

The present invention relates to a joint structure capable of reinforcing bridges and buildings, and more particularly to the joint structure with at least one restraining member capable of enhancing the buckling strength of steel plates, and the joint structure is installed on a side of a gusset plate (or a joint plate) of a truss or a diagonal brace to prevent buckling caused by lateral deformations of the gusset plate.

2. Description of Related Art

Gusset plate (also known as joint plate) is generally installed between a chord member, a beam member and a column member and connected to a truss web member or a two-force member to transmit loads, and thus the gusset plate can be applied in bridges and buildings. In general, most gusset plates are made of steel plates, and the steel plates are galvanized or coated to protect the gusset plate from being rusted, so that most galvanized steel plates can be used outdoors. Occasionally, the gusset plate is made of copper or aluminum, but the copper or aluminum gusset plate can be used only in small structures that do not require large supporting strengths. Due to the properties of copper or aluminum, the copper or aluminum gusset plates are usually used in structures outdoors.

With reference to FIG. 1A for a schematic view of a conventional gusset plate applied in a connection of braced frames, the gusset plate A2 is connected to a column structure A3 and a beam structure A4, and a diagonal brace A1 is connected to the gusset plate A2 to form a part of the conventional braced structure. The gusset plate A2 is disposed at a position where the column structure A3, the beam structure A4 and the diagonal brace A1 are connected for providing a function of transmitting forces. In general, the larger the force, the bigger is the gusset plate A2. The conventional structure can be used in bridges, and deformations and vibrations may be induced by the weight of a bridge, a car or an earthquake, such that each member will produce internal forces. In FIG. 1B, when the diagonal brace A1 bears a compression F, the diagonal brace A1 is in equilibrium with adjacent elements through the gusset plate A2. Now, the gusset plate A2 distributes the stress according to the load and stiffness. With the effect of complex geometric shape, the distribution of the stress is complicated. In addition, the conventional structure can be applied in braced frame buildings. When an earthquake occurs, the buildings will induce a lateral load caused by ground motion. Now, the diagonal brace is located on a path that transmits seismic forces most directly, and thus the diagonal brace becomes the key component for seismic resistant design, wherein the gusset plate A2 is the main component for transmitting a load into and out from the diagonal brace.

From the description above, we clearly understand the components and structure of the conventional diagonal brace structure and the gusset plate A2 capable of transmitting stress between the conventional diagonal brace members. However, when the gusset plate A2 bears a larger compression, lateral deformation and buckling will occur to affect the axial stiffness and strength of the gusset. With reference to FIG. 1B for a schematic view, showing the buckling occurred in a gusset plate when stress is induced from a conventional truss member, when the conventional diagonal brace member produces a stress, the gusset plate A2 may be subjected to a compression F, such that the gusset plate A2 is deformed to buckle, and the strength and stiffness of the gusset plate A2 will drops as the lateral deformation increases to result in asymmetrical tensile and compressive behavior of the gusset plate A2, so as to affect the seismic resistant capacity of the bridges or buildings.

At present, researchers tend to break through the conventional technologies to prevent the gusset plate from buckling too early, so that an auxiliary structure of the stiffened plate is developed. With reference to FIG. 1C for a schematic view of a conventional stiffened plate installed at an edge of a gusset plate, two conventional stiffened plates A5 are welded to two edges of the gusset plate A2 respectively to enhance the strength of the gusset plate A2. However, test results show that although the stiffened plates A5 can prevent free edges of the gusset plate A2 from occurring local buckling, yet the overall lateral deformation and buckling still may occur, and the conventional stiffened plate A5 is welded to the gusset plate A2, so that the stiffened plate will participate the axial load distribution and affect the deformation capacity of the gusset plate.

In view of the aforementioned drawbacks of the conventional gusset plate applied to a diagonal brace, the inventor of the present invention based on years of practice experience in the related industry to conduct extensive researches and experiments, and finally developed a laterally restrained joint structure in accordance with the present invention to overcome the drawbacks of the prior art.

SUMMARY OF THE INVENTION

Therefore, it is a primary objective of the invention to provide a laterally restrained joint structure comprising a restraining member installed over a side or at an edge of a gusset plate or a two-force member and coupled to a chord, beam or column member, so that the restraining member can prevent the gusset plate or the two-force member from occurring unexpected global or local lateral deformation, so as to achieve the effects of enhancing the buckling strength of the gusset plate, reinforcing buildings, and satisfying the design requirements for safety and reliability.

To achieve the aforementioned objective, the present invention provides a laterally restrained joint structure applied in structures, comprising: at least one structural member; a gusset plate, connected to the structural member, and at least one two-force member coupled to the gusset plate with respect to the structural member; and at least one restraining member, installed over the side of the gusset plate or the two-force member, and coupled to the structural member; wherein the structural member can be a truss member, a chord member, a beam member or a column member, and the two-force member can be a truss web or a diagonal brace member.

Wherein, the restraining member is installed on the gusset plate to provide lateral bracing of the gusset and enhance the buckling strength of the gusset plate. The lateral deformation of the gusset induced by axial compression is determined by the buckling modes of the gusset plate. In the meantime, the buckling modes of the gusset plate further determine the geometry and the location of the first side of the restraining member.

DETAILED DESCRIPTION OF THE PREFERRED EMBODIMENTS

The technical contents and characteristics of the present invention will be apparent with the detailed description of a preferred embodiment accompanied with related drawings as follows. It is noteworthy that the drawings are provided for the purpose of illustrating the present invention, but not intended for limiting the scope of the invention.

Figure 1A:
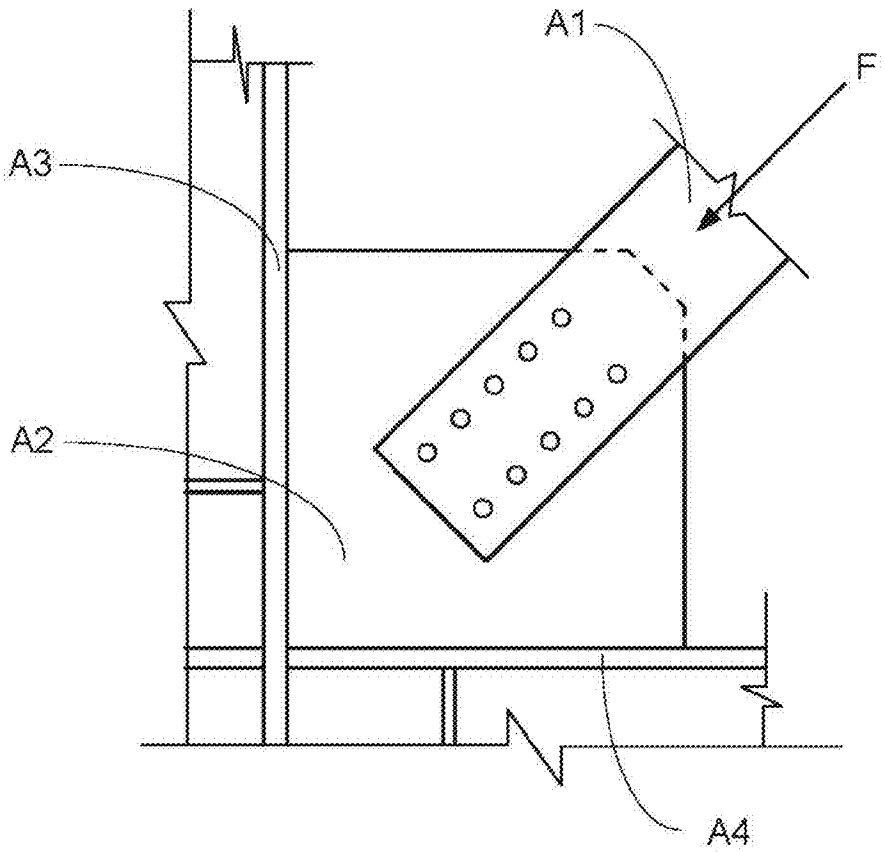
FIG. 1A is a schematic view of a conventional gusset plate applied in a diagonal brace and a truss member.
Figure 1B:
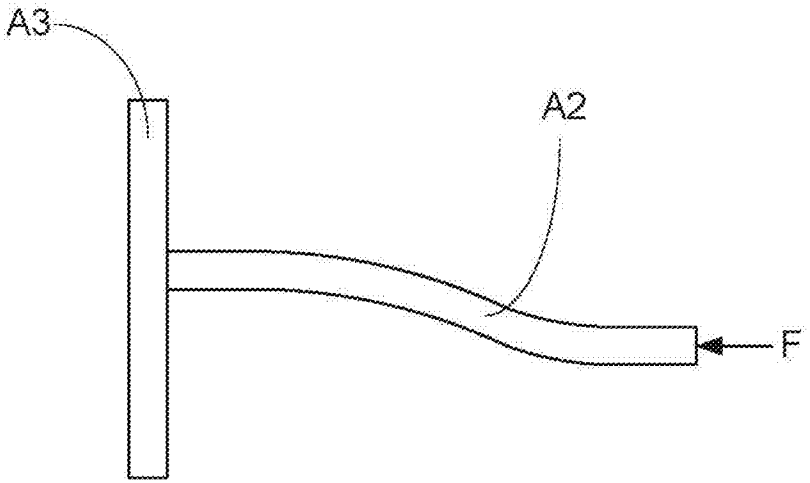
FIG. 1B is a schematic view, showing the buckling occurred in a conventional gusset plate subjected to compression.
Figure 1C:
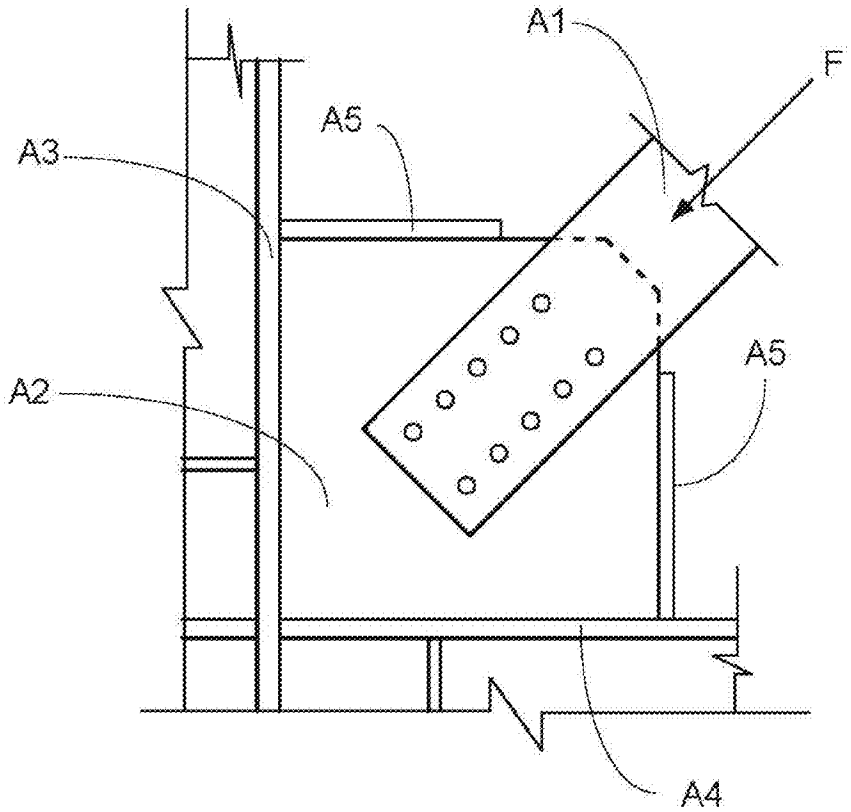
FIG. 1C is a schematic view of a conventional stiffened plate installed at an edge of a gusset plate.
Figure 2B:
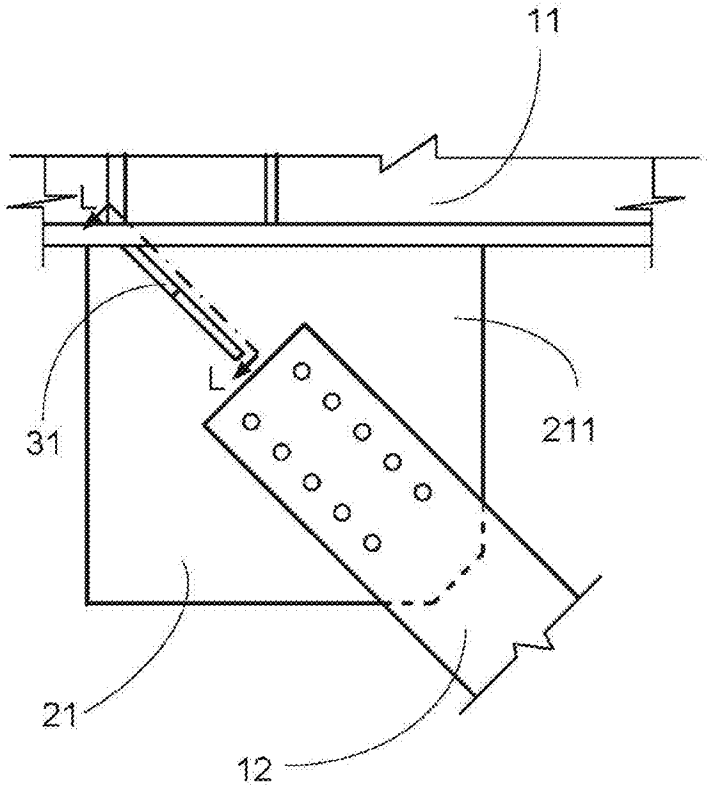
FIGS. 2A and 2B are schematic views of a joint structure in accordance with a first preferred embodiment of the present invention.
Figure 2A:
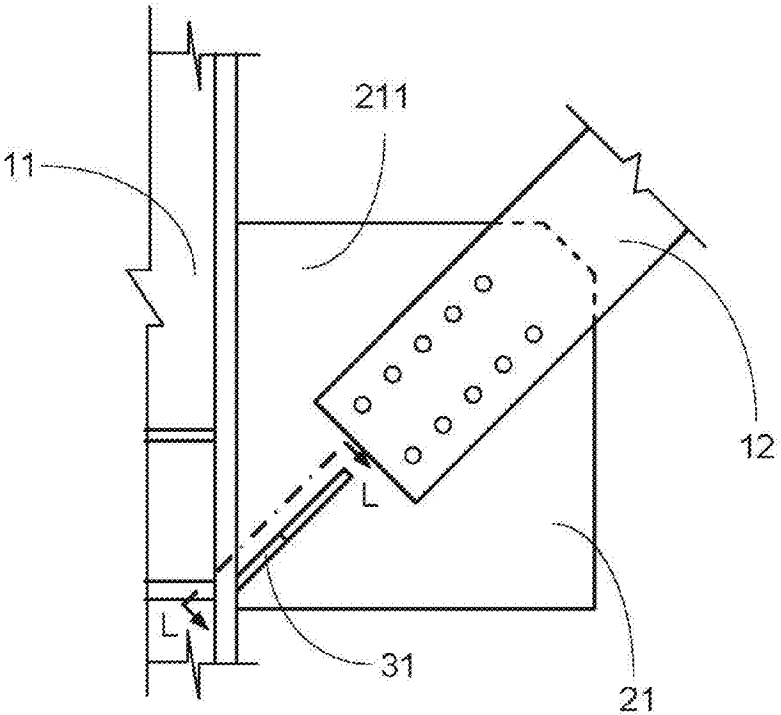

With reference to FIGS. 2A and 2B for schematic views of a joint structure in accordance with the first preferred embodiment of the present invention, the joint structure is a laterally restrained joint structure used in a structure, and the laterally restrained joint structure comprises: a structural member 11 for an architectural structure; a gusset plate 21, having at least one side 211, and connected to the structural member 11, and a two-force member 12 jointed to the gusset plate 21 with respect to the structural member 11; and a restraining member 31, installed over the side 211 of the gusset plate 21, and connected to the structural member 11; wherein the structural member 11 can be a truss chord member, a beam member or a column member, and the two-force member 12 can be a truss web or a diagonal brace member, and the restraining member 31 is preferably made of steel.

Figure 2C:
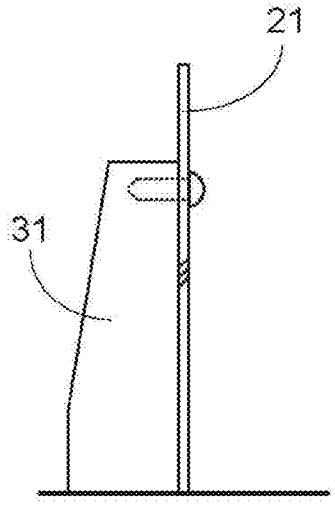
FIGS. 2C and 2D are schematic views of section lines L showing two connecting modes of a restraining member with a gusset plate in accordance with the present invention respectively.
Figure 2D:
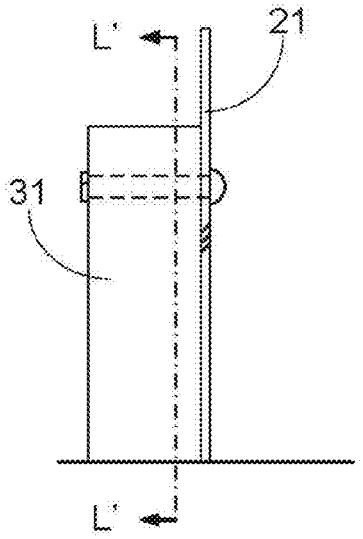
Figure 2E:
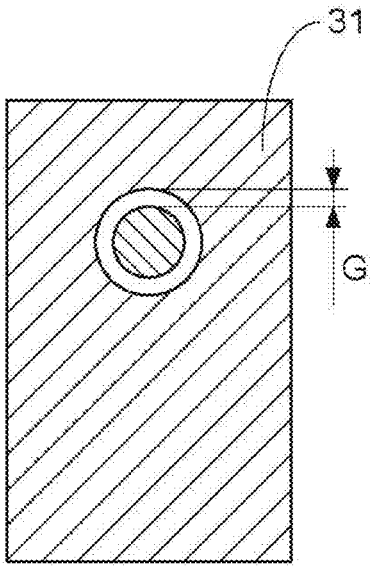
FIG. 2E is a schematic view of a section line L' as depicted in FIG. 2D, showing a mode of a bolt passing through a restraining member.

With reference to FIGS. 2C and 2D for schematic views of section lines L as depicted in FIGS. 2A and 2B, showing two connecting modes of a restraining member with a gusset plate in accordance with the present invention, FIG. 2C and FIG. 2D show that the restraining member 31 is jointed to the gusset plate 21 by bolts With reference to FIG. 2E for a schematic view of a section line L' as depicted in FIG. 2D, showing a mode of a bolt passing through a restraining member, the restraining member 31 exists a hole for passing the bolt, and a gap G is maintained between the hole and the bolt. After a force is applied onto the gusset plate 21, the bolt can move within an allowable range of the gap G, so that the restraining member 31 will not be compressed, pulled or stretched together with the gusset plate 21.

Figure 2F:
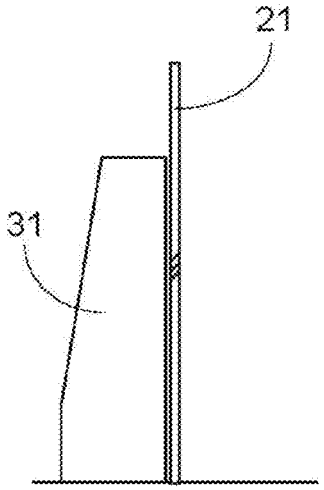
FIGS. 2F to 2H for schematic views of section lines L as depicted in FIGS. 2A and 2B respectively, showing other three connecting modes of a restraining member with a gusset plate in accordance with the present invention.
Figure 2G:
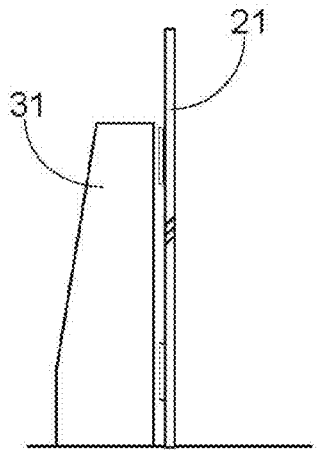

With reference to FIGS. 2F and 2G for schematic views of section lines L as depicted in FIGS. 2A and 2B respectively, showing other two connecting modes of a restraining member with a gusset plate in accordance with the present invention, FIG. 2F shows that a small gap is maintained between the restraining member 31 and the gusset plate 21 without requiring any fastening element such as a bolt, and the restraining member 31 may even in direct contact with the gusset plate 21. In addition, the restraining member 31 may be coupled to the gusset plate 21 by part weld in special situations as shown in FIG. 2G.

Figure 2H:
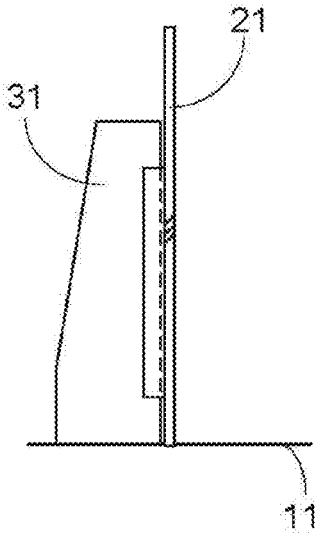
Figure 2I:
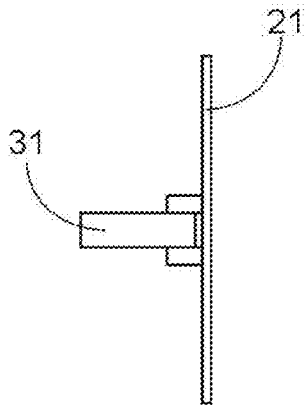
FIG. 2I is a top view of FIG. 2H.

With reference to FIG. 2H for a top view of a section line L as depicted in FIGS. 2A and 2B, showing another connecting mode of a restraining member with a gusset plate in accordance with the present invention, the gusset plate 21 has two ribs, and the restraining member 31 is installed between the two ribs and a small gap is maintained between the retraining member 31 and the gusset plate 21.

Figure 2J:
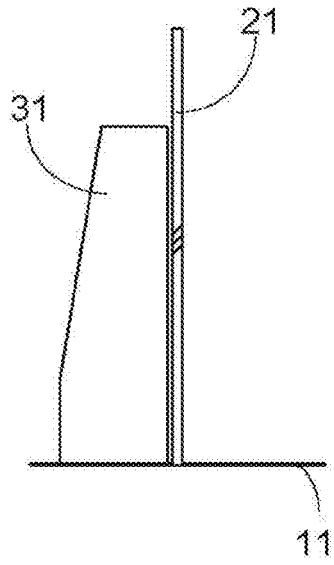
FIGS. 2J to 2L are schematic views of section lines L as depicted in FIGS. 2A and 2B respectively, showing three connecting modes of a restraining member with a structural member in accordance with the present invention.
Figure 2K:
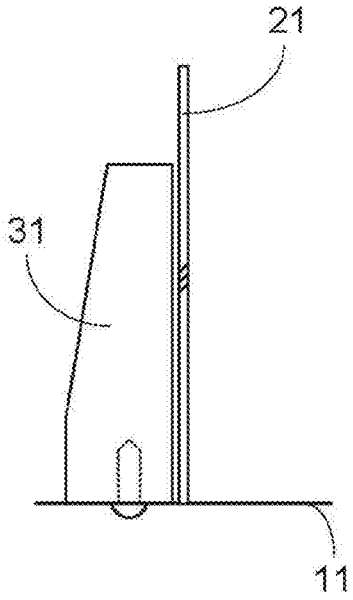
Figure 2L:
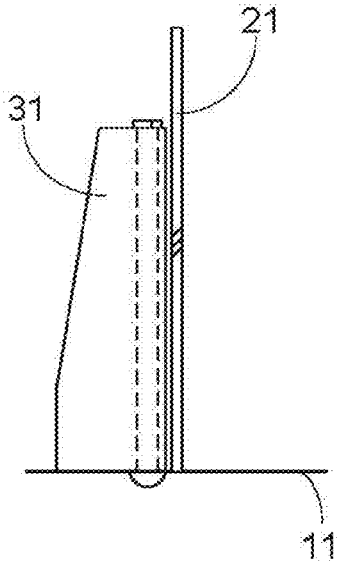

With reference to FIGS. 2J to 2L for schematic views of section lines L as depicted in FIGS. 2A and 2B respectively, showing three connecting modes of a restraining member with a structural member in accordance with the present invention, FIG. 2J shows that the restraining member 31 is connected to the structural member 11 directly by weld, FIG. 2K and FIG. 2L show that the restraining member 31 is connected to the structural member 11 by bolts. The connecting method adopted by the present invention primarily provides a connection with lateral supports, so that the aforementioned three connecting methods are provided as examples for the purpose of illustrating the present invention, but not intended for limiting the scope of the present invention.

Figure 3B:
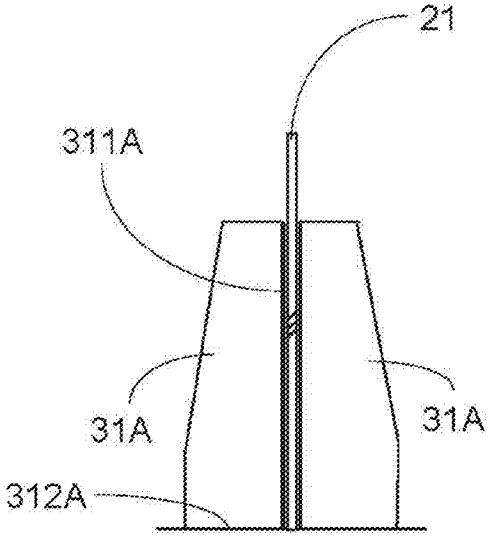
FIGS. 3A and 3B are schematic views of a joint structure in accordance with a second preferred embodiment of the present invention.
Figure 3A:
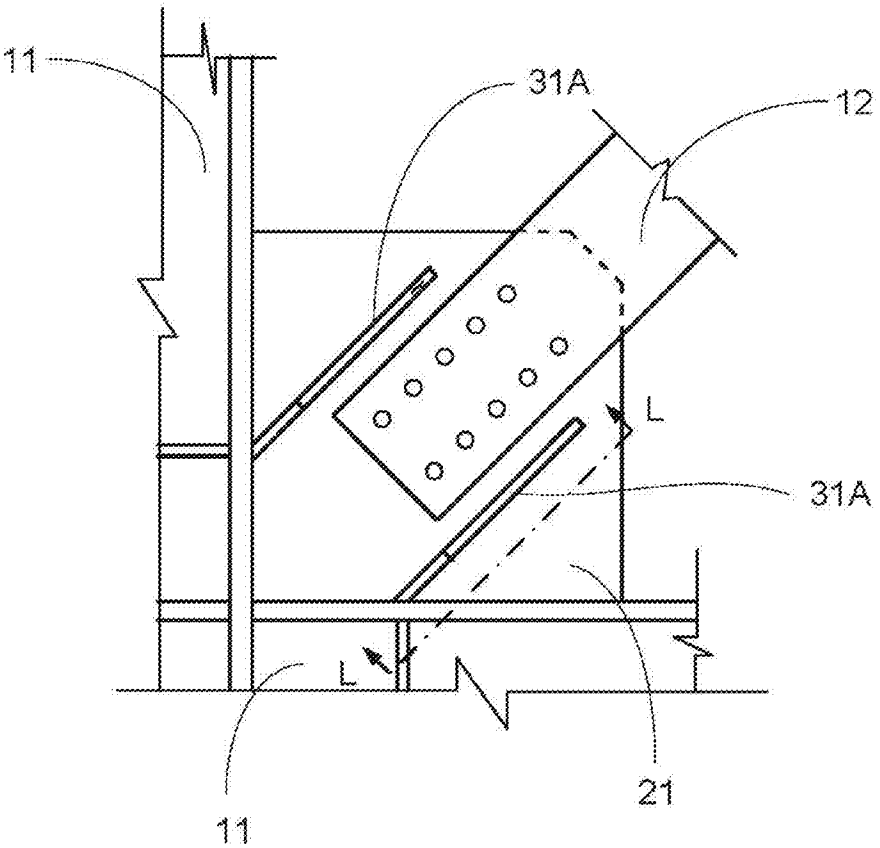

With reference to FIGS. 3A and 3B for schematic views of a joint structure in accordance with the second preferred embodiment of the present invention, FIG. 3B shows a section line L as depicted in FIG. 3A, illustrating a side view of the second preferred embodiment. In the second preferred embodiment, two structural members 11 are connected to the gusset plate 21, and the gusset plate 21 is connected to the two-force member 12, and four restraining members 31A are installed on two sides of the gusset plate 21 respectively, and each restraining member 31A has a first side 311A and a second side 312A, wherein the first side 311A is disposed on the gusset plate 21 and at a position where the lateral deformation is taken place to be controlled to enhance the buckling strength of the gusset plate 21. Wherein, the position that will produce lateral displacement is determined by the buckling modes of the gusset plate 21. In the meantime, the buckling modes further determine the shape and dimension of the first side 311A. The buckling modes are used for defining the range of points, lines, and surfaces of out-of-plane deformations of the gusset plate 21, so that the lateral deformation of the gusset around the restraining member 31A can be restrained. The second side 312A is disposed adjacent to the first side and connected to the structural member 11 by weld, a bolt or a connecting plate. Wherein, the aforementioned two structural members 11 are a beam member and a column member respectively.

Figure 4B:
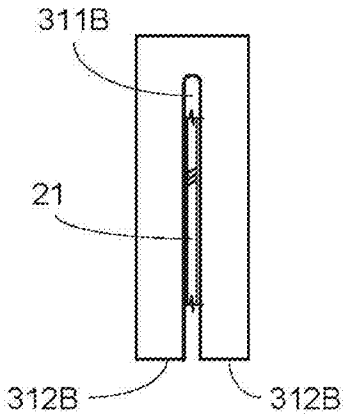
FIGS. 4A to 4C are schematic views of a joint structure in accordance with a third preferred embodiment of the present invention.
Figure 4C:
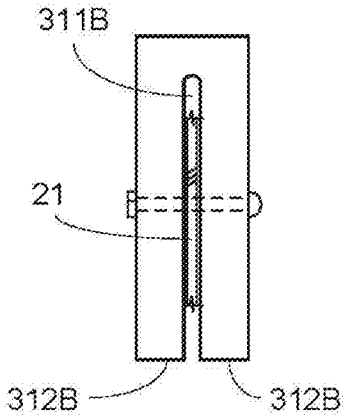
Figure 4A:
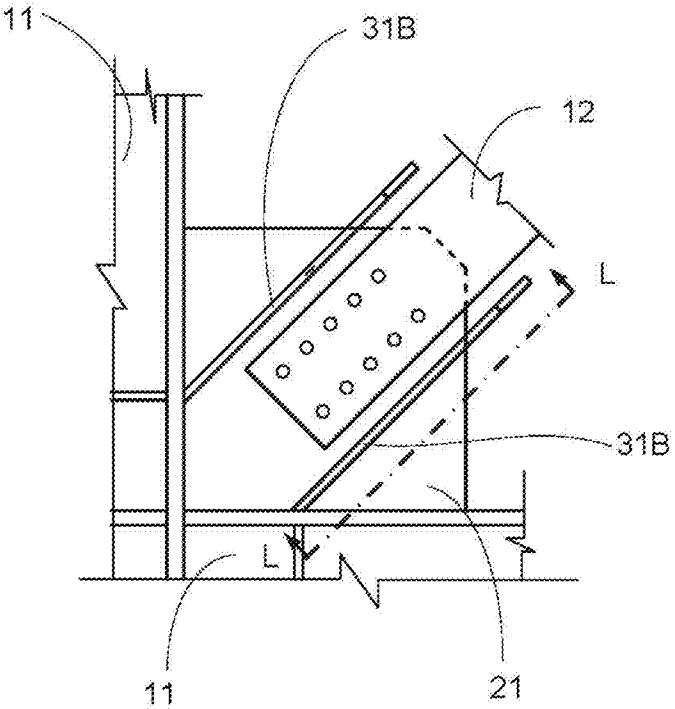

With reference to FIGS. 4A to 4C for schematic views of a joint structure in accordance with the third preferred embodiment of the present invention, FIGS. 4B and 4C show the section lines L as depicted in FIG. 4A, and the third preferred embodiment of the present invention is substantially the same as the second preferred embodiment, wherein two structural members 11 are connected to the gusset plate 21, and the gusset plate 21 is connected to the two-force member 12. In addition, the third preferred embodiment further comprises two restraining members 31B, and each of the restraining members 31B comprises: a gusset plate containing slot 311B, for containing the gusset plate 21 and restraining a lateral deformation of the gusset plate 21 to enhance the buckling strength of the gusset plate 21; and two member connecting ends 312B. When the gusset plate 21 is contained in the gusset plate containing slot 311B, the two member connecting ends 312B are jointed to the first structural member 11.

In FIG. 4B, when the gusset plate 21 is contained in the gusset plate containing slot 311B, two opposite sides of the gusset plate 21 maintain a gap from the gusset plate containing slot 311B. In FIG. 4C, the gusset plate 21 is contained in the gusset plate containing slot 311B of the restraining member and connected by bolts, The connecting methods are used for the purpose of illustrating the present invention only, but not intended for limiting the scope of the present invention. Other connecting methods such as solders, bolts, protruding limbs, or insert slots also can be used instead.

Figure 5B:
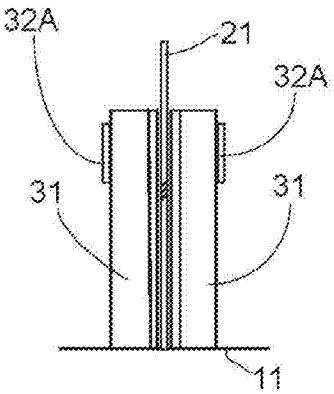
FIGS. 5A to 5C are schematic views of a joint structure in accordance with a fourth preferred embodiment of the present invention.
Figure 5C:
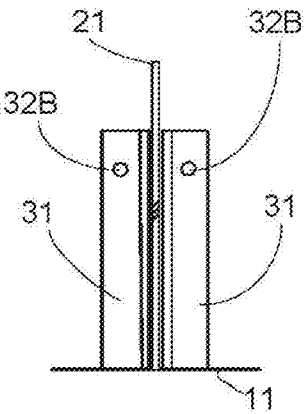
Figure 5A:
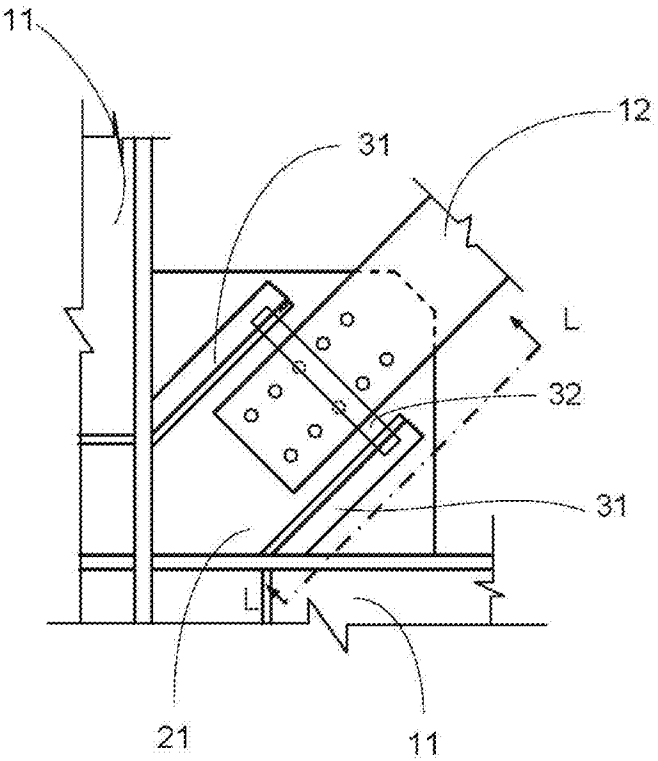

With reference to FIGS. 5A to 5C for schematic views of a joint structure in accordance with the fourth preferred embodiment of the present invention, FIGS. 5B and 5C show the section line L as depicted in FIG. 5A to illustrate the side view of the four preferred embodiment, and the basic components of the fourth preferred embodiment of the present invention are substantially the same as those of the second preferred embodiment, and the fourth preferred embodiment further comprises a fastening element 32, wherein when two restraining members 31 are installed on a side of the gusset plate 21, the fastening element 32 is connected to the two restraining members 31. In addition, the present invention provides two types of fastening elements. In FIG. 5B, the two fastening elements 32A are steel plates connected to the two restraining members 31 respectively. In FIG. 5C, the two restraining members 31 are linked by two fasteners 32B.

Figure 6A:
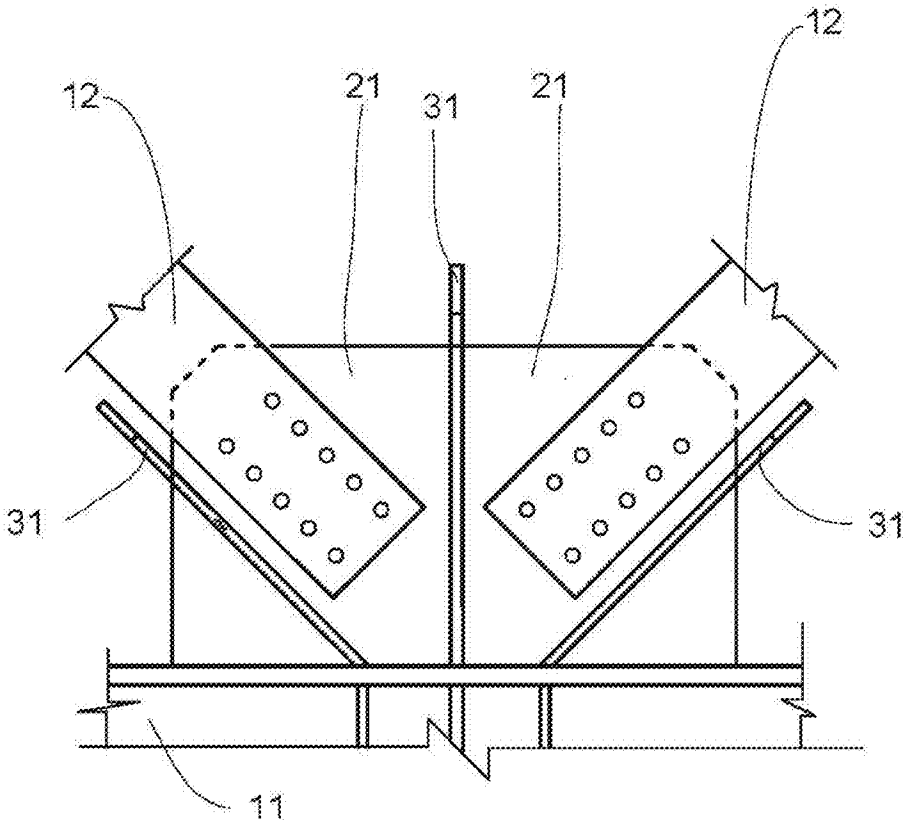
FIG. 6A is a schematic view of a joint structure in accordance with a fifth preferred embodiment of the present invention.
Figure 6C:
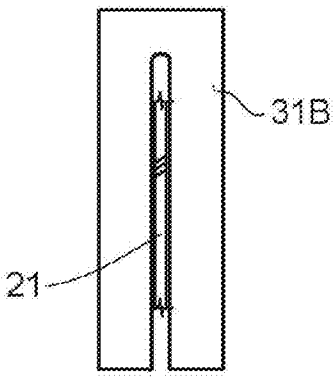
FIGS. 6B and 6C are schematic views of a joint structure in accordance with a sixth preferred embodiment of the present invention.
Figure 6B:
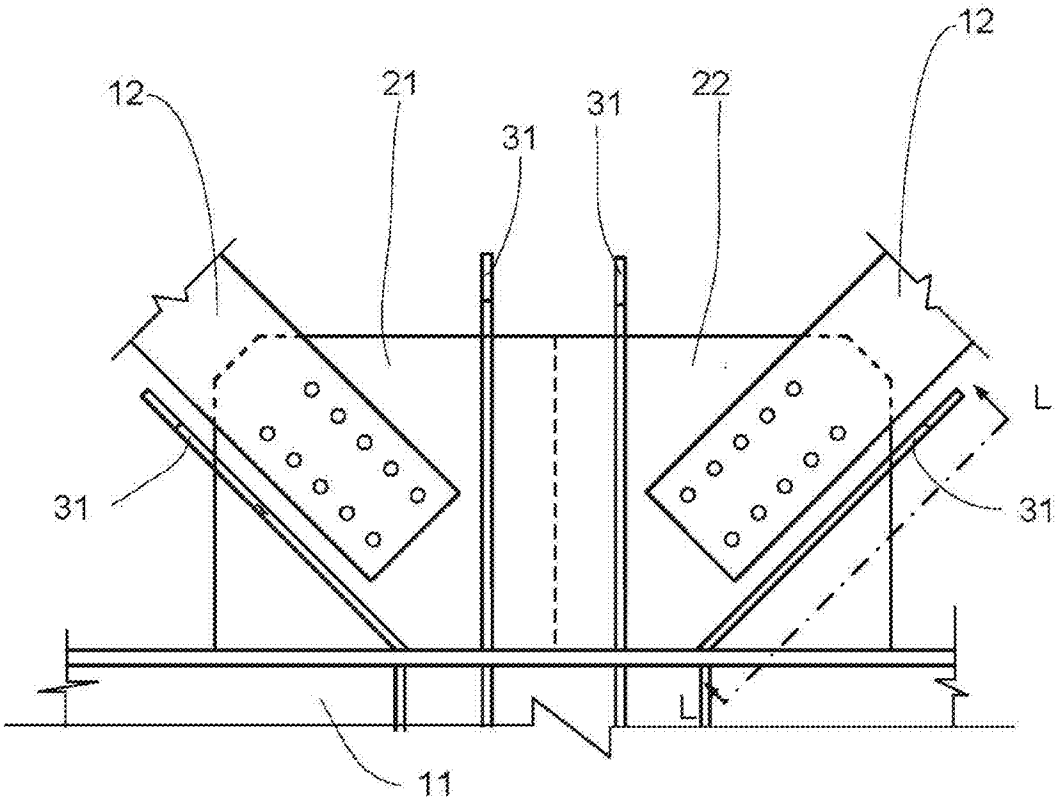

With reference to FIG. 6A for a schematic view of a joint structure in accordance with the fifth preferred embodiment of the present invention, the same contact of the structural design of this embodiment generally has two or more two-force members, and the gusset plate 21 of this embodiment can be connected to two two-force members 12, and the restraining member 31 is installed at an appropriate position of the gusset plate 21 and connected to the structural member 11. With reference to FIGS. 6B and 6C for schematic views of a joint structure in accordance with a sixth preferred embodiment of the present invention, FIG. 6C shows the section line L as depicted in FIG. 6B to illustrate a side view of the sixth preferred embodiment, wherein another gusset plate 22 is coupled to the gusset plate 21 and connected to a structural member 11, and the restraining member 31 is installed at an appropriate position of the gusset plate 21.

Figure 7A:
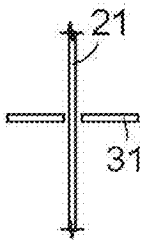
FIGS. 7A to 7O are schematic views of cross-sectional shapes of the restraining members in accordance with the present invention.
Figure 7B:
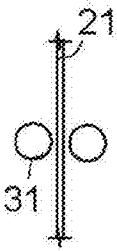
Figure 7C:
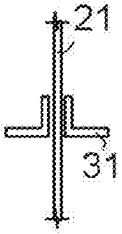
Figure 7D:
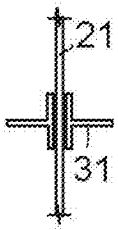
Figure 7E:
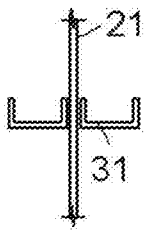
Figure 7F:
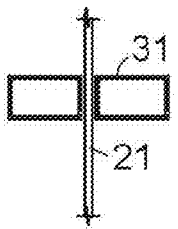
Figure 7G:
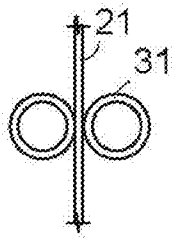
Figure 7H:
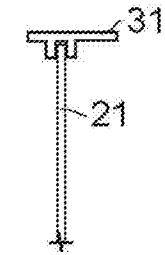
Figure 7I:
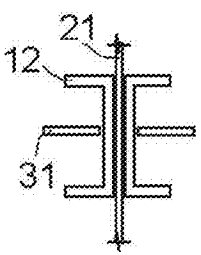
Figure 7J:
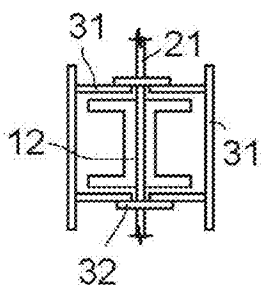
Figure 7K:
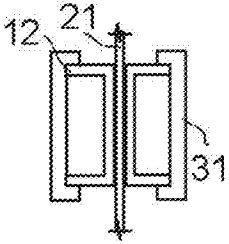
Figures 7L, 7M, 7N, 7O:
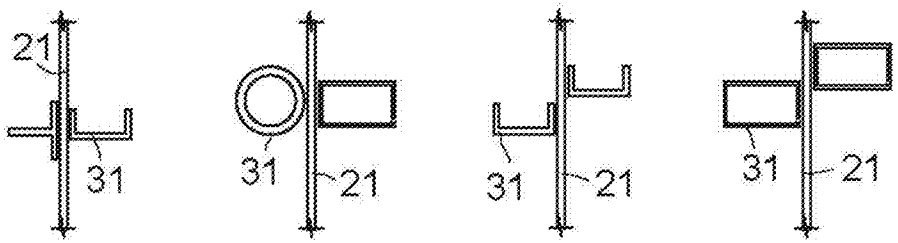

With reference to FIGS. 7A to 7N for schematic views of the shapes of cross-sections of the restraining members in accordance with the present invention, the present invention provides at least 15 kinds of restraining members, and the restraining members 31 can be in an L-shape, an I-shape, a H-shape, an U-shape, a T-shape, a C-shape, a circular shape, or a square shape. FIGS. 7A to 7N show the L-shaped, I-shaped, H-shaped, U-shaped, T-shaped, C-shaped, circular, or square restraining members 31 respectively, and FIGS. 7F and 7G show that the restraining members 31 are in a hollow tube and a hollow pipe respectively, and FIG. 7H shows that the restraining member 31 has a groove for containing the gusset plate 21; and FIG. 7I shows that the restraining member can be placed at an edge of the two-force member 12 while providing lateral supports to the gusset plate 21 and the two-force member 12, and the two-force member 12 is C-shaped and connected to a side of the gusset plate 21, and the I-shaped restraining member 31 is installed on a side of the two-force member 12. In FIG. 7J, a π-shaped restraining member 31 is installed on a side of the two-force member 12, and the direction of the restraining member 31 is not limited to the direction parallel to the two-force member only. In FIG. 7K, a C-shaped restraining member 31 is installed on a side of a C-shaped two-force member 12. In FIGS. 7L to 7O, the shapes and positions of the restraining members 31 are illustrated, but the invention can be adjusted according to a required structural design.

Figure 8A:
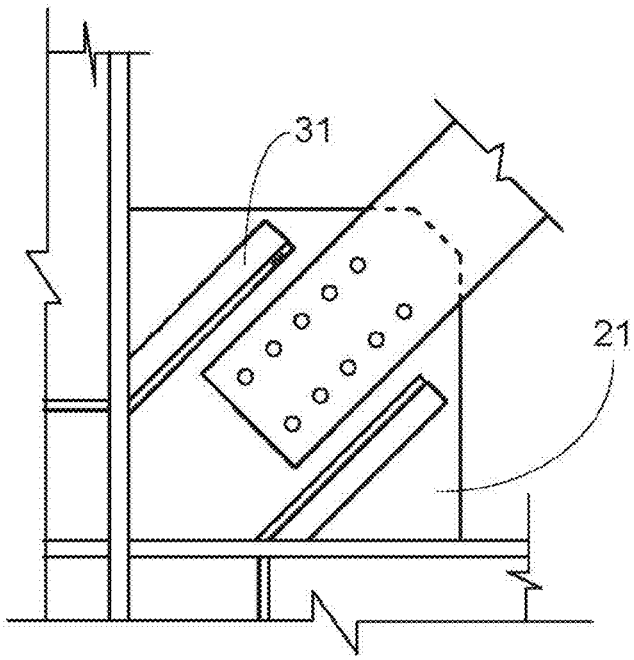
FIGS. 8A to 8C are schematic views of an implementation of a restraining member in accordance with the present invention.
Figure 8B:
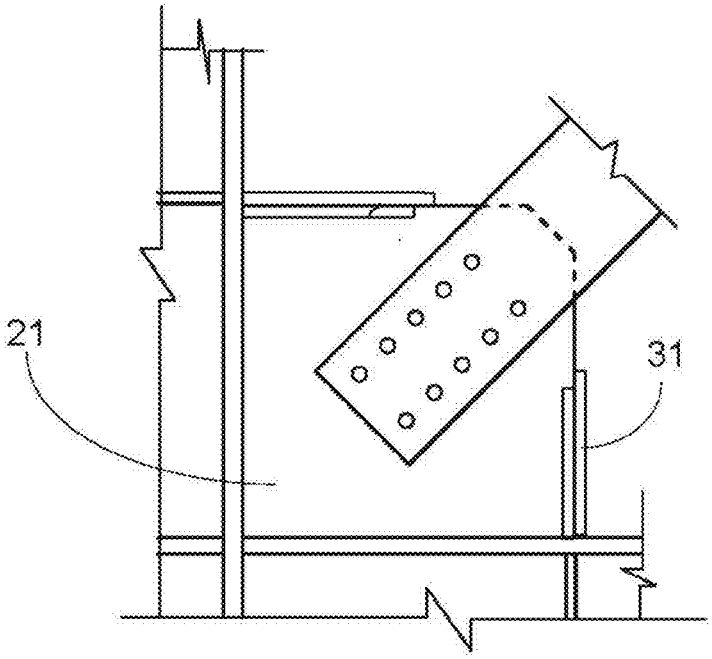
Figure 8C:
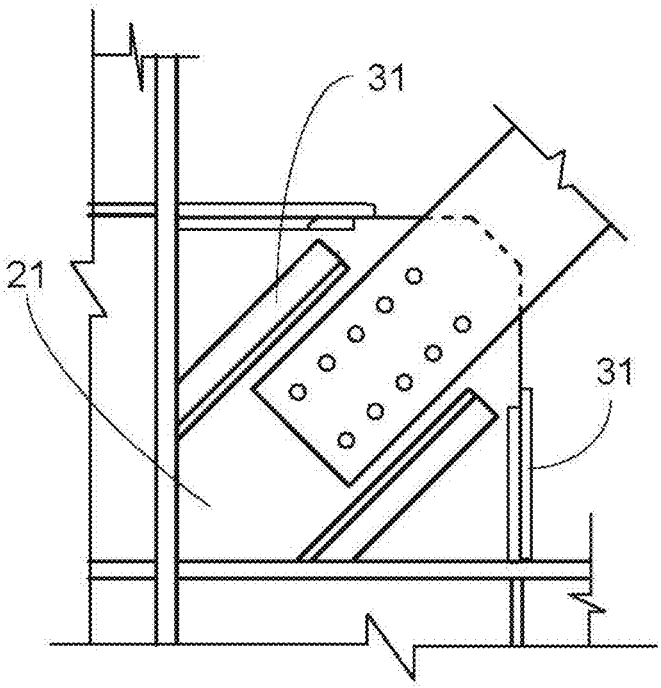

With reference to FIGS. 8A to 8C for schematic views of the restraining members of the present invention, FIG. 8A is corresponsive to FIG. 7C and shows an L-shaped restraining member 31, and the L-shaped restraining member 31 is installed on a side of the gusset plate 21; FIG. 8B is corresponsive to FIG. 7H and shows a restraining member 31 having a groove for containing the gusset plate 21; and FIG. 8C shows that the gusset plate 21 has two types of restraining members 31 including an L-shaped restraining member 31 as shown in FIG. 8A and a restraining member 31 with a groove as shown in FIG. 8B.

Figure 9A:
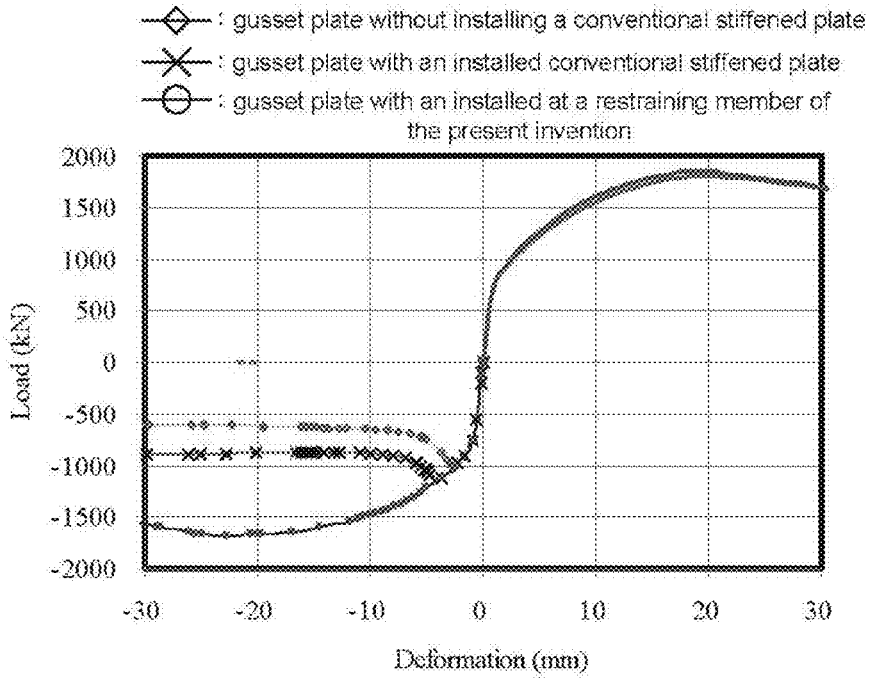
FIG. 9A is a figure that compares the analysis results of axial load-displacement relationship of a gusset plate without installing a conventional stiffened plate, a gusset plate with a conventional stiffened plate, and a gusset plate with a restraining member of the present invention respectively.

With reference to FIG. 9A for a curve that compares the analysis results of a gusset plate subjected to monotonic loads without installing a conventional stiffened plate, a gusset plate with an installed conventional stiffened plate, and a gusset plate with an installed restraining member of the present invention restraining member respectively, the results is obtained by performing a finite element analysis (FEA), wherein the gusset plate without installing a conventional stiffened plate has a maximum compression capacity of 1025 kN, and the gusset plate installed at the conventional stiffened plate has a maximum compression capacity of 1135 kN, and the gusset plate installed at a restraining member of the present invention has a maximum compression capacity up to 1678 kN, and their relative proportion is equal to 1:1.1:1.63. Obviously, the restraining member of the present invention can improve the compression capacity of the gusset plate significantly.

Figure 9B:
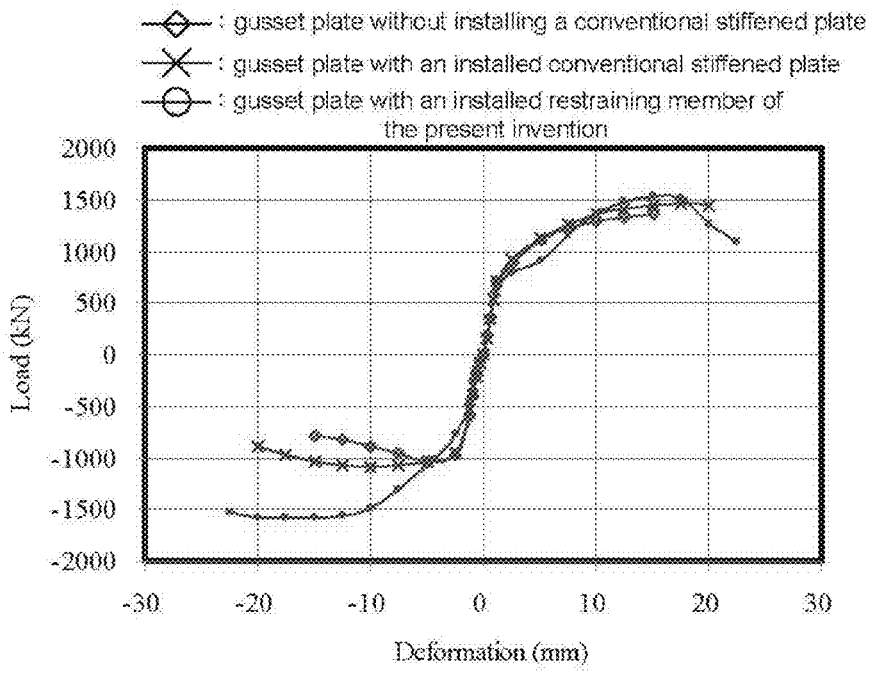
FIG. 9B shows envelope curves that compare the cyclic loading test results of a gusset plate without any stiffener, a gusset plate with a conventional stiffened plate and a gusset plate with a restraining member of the present invention respectively.

This technology is also verified by a testing method. With reference to FIG. 9B for an envelope curve that compares the test results of cyclic loading tests of a gusset plate without installing a conventional stiffened plate, a gusset plate with an installed conventional stiffened plate and a gusset plate with an installed restraining member of the present invention respectively, the gusset plate without installing a conventional stiffened plate has a maximum compression capacity of 1084 kN, the gusset plate with an installed conventional stiffened plate has a maximum compression capacity of 1144 kN, and the gusset plate installed at a restraining member of the present invention has a maximum compression capacity up to 1604 kN, and their relative proportion is equal to 1:1.06:1.48. Obviously, the restraining member of the present invention can improve the compression capacity of the gusset plate significantly.

In summation, the restraining member of the present invention still can enhance the compression capacity of the gusset plate in the cyclic loading conditions, and the effect of the restraining member of the present invention is better than that of the conventional stiffened plate.

Figure 10:
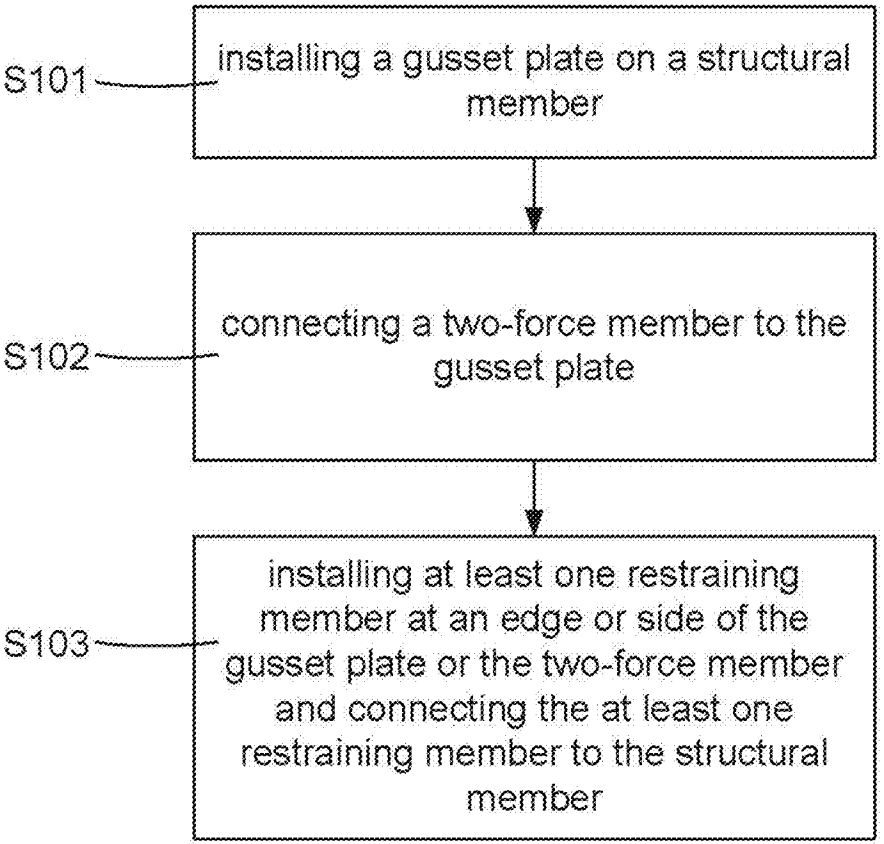
FIG. 10 is a flow chart of a method of reinforcing a building by a joint structure of the present invention.

With reference to FIG. 10 for a flow chart of a method of reinforcing a building by a joint structure of the present invention, the method comprises the following steps:

S101: connecting a gusset plate to a structural member.

S102: A two-force member is connected to the gusset plate.

S103: At least one restraining member is installed at an edge or over a side of the gusset plate and connected to the structural member. In the step S103, the restraining member is installed on a side of the structural member while maintaining a gap and a metal contact by means of a fastening element, weld, or a bolt, and the structural member includes a chord member, a beam member and a column member. In addition, the restraining member is installed to the gusset plate and at a position that will produce a lateral displacement.

In summation, a laterally restrained joint structure in accordance with the present invention is disclosed clearly and sufficiently by the foregoing preferred embodiments, and the laterally restrained joint structure of the present invention provided by a restraining member is installed on a side of a gusset plate or a two-force member and connected to a beam member and a column member. Compared with the conventional stiffened plate, the restraining member of the present invention can restrain the gusset plate or the two-force member from producing a lateral deformation at end points of the gusset plates or the two-force member, so as to provide a better compression resistance and a better lateral rotating strength of the gusset plate without affecting the ability of the gusset plate being deformed by pulling forces and rotations, so that the laterally retrained joint structure can be used for enhancing buildings and bridges to provide better reliability and safety.

While the invention has been described by means of specific embodiments, numerous modifications and variations could be made thereto by those skilled in the art without departing from the scope and spirit of the invention set forth in the claims.

What is claimed is:

1. A laterally restrained joint structure of an architectural structure, comprising:

at least one structural member;

at least one two-force member;

a gusset plate fixedly connected to the structural member and the two-force member; and at least one restraining plate member each connected to both the gusset plate and one of the at least one structural member, said each restraining plate member having at least four edges with the first edge and the second edge being adjacent to and substantially perpendicular to each other, wherein the first edge is connected to the gusset plate with a gap there between in a location in which lateral deformation of the gusset plate being predicted from a buckling analysis of the gusset plate, the second edge is fixedly connected to said one of the at least one structural member, and the remaining edges are free edges without connecting to the at least one structural member, the at least one two-force member and the gusset plate; and the restraining plate member further includes:

a gusset plate containing slot for containing the gusset plate and covering a position where a lateral deformation takes place, so as to enhance the buckling strength of the gusset plate; and two member connecting ends connected to the structural member when the gusset plate it contained in the gusset plate containing slot;

wherein the position where the lateral deformation takes place is determined by the buckling modes of the gusset plate, and the buckling modes of the gusset plate further determine the geometry and size of the restraining member.

2. The laterally restrained joint structure of claim 1, wherein the structural member is selected from the group consisting of a truss member, a chord member, a beam member and a column member.

3. The laterally restrained joint structure of claim 1, wherein the gusset plate is installed in the gusset plate containing slot by means of riveting, welding, or bolting.

4. The laterally restrained joint structure of claim 1, wherein the gusset plate is installed in the gusset plate containing slot and contacts with the gusset plate containing slot directly, when the gusset plate is contained in the gusset plate containing slot.

5. The laterally restrained joint structure of claim 1, wherein the gusset plate containing slot maintains a gap from two opposite sides of the gusset plate when the gusset plate is contained in the gusset plate containing slot.

6. The laterally restrained joint structure of claim 1, further comprising:

two restraining plate members, installed over opposite sides of the gusset plate, respectively;

at least one second gusset plate connected to the gusset plate and the structural member; and a fastening element connected to said two restraining plate members.

7. The laterally restrained joint structure of claim 1, wherein the largest lateral deformation is a combination of one or more buckling modes predicated in the buckling analysis of the gusset plate.

8. A laterally restrained joint structure of an architectural structure, comprising:

at least one structural member;

at least one two-force member;

a gusset plate fixedly connected to the structural member and the two-force member; and at least one restraining plate member each connected to both the gusset plate and one of the at least one structural member, said each restraining plate member having at least four edges with the first edge and the second edge being adjacent to and substantially perpendicular to each other, wherein the first edge is contacted to the gusset plate between in a location in which lateral deformation of the gusset plate being predicted from a buckling analysis of the gusset plate, the second edge is fixedly connected to said one of the at least one structural member, and the remaining edges are free edges without connecting to the at least one structural member, the at least one two-force member and the gusset plate; and the restraining plate member further includes:

a gusset plate containing slot for containing the gusset plate and covering a position where a lateral deformation takes place, so as to enhance the buckling strength of the gusset plate; and two member connecting ends connected to the structural member when the gusset plate it contained in the gusset plate containing slot;

wherein the position where the lateral deformation takes place is determined by the buckling modes of the gusset plate, and the buckling modes of the gusset plate further determine the geometry and size of the restraining member.

9. A laterally restrained joint structure of an architectural structure, comprising:

at least one structural member;

at least one two-force member;

a gusset plate fixedly connected to the structural member and the two-force member; two restraining plate members, installed over opposite sides of the gusset plate, respectively, and each connected to both the gusset plate and one of the at least one structural member, said each restraining plate member having at least four edges with, the first edge and the second edge being adjacent to and substantially perpendicular to each other, wherein the first edge is connected to the gusset plate with a gap there between, the second edge is fixedly connected to said one of the at least one structural member, and the remaining edges are free edges without connecting to the at least one structural member, the at least one two-force member and the gusset plate;

at least one second gusset plate connected to the gusset plate and the structural member; and a fastening element connected to said two restraining plate members.

* * * * *